US008899203B2

(12) United States Patent
Thomas

(10) Patent No.: US 8,899,203 B2
(45) Date of Patent: Dec. 2, 2014

(54) ENGINE POSITION IDENTIFICATION

(75) Inventor: Joseph Lyle Thomas, Kimball, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 1615 days.

(21) Appl. No.: 11/767,204

(22) Filed: Jun. 22, 2007

(65) Prior Publication Data

US 2008/0314359 A1 Dec. 25, 2008

(51) Int. Cl.

| | |
|---|---|
| ***F02D 41/06*** | (2006.01) |
| ***F02D 35/02*** | (2006.01) |
| ***F02N 11/08*** | (2006.01) |
| ***F02D 41/00*** | (2006.01) |
| ***F02D 41/38*** | (2006.01) |

(52) U.S. Cl.

CPC ..... *F02D 41/062* (2013.01); *F02D 35/023* (2013.01); *F02N 11/08* (2013.01); *F02D 41/009* (2013.01); *F02D 41/3809* (2013.01); *F02D 2041/0095* (2013.01); *F02D 2200/0408* (2013.01); *F02D 2200/0602* (2013.01)

USPC ..... 123/179.3; 123/406.22

(58) Field of Classification Search

CPC ..... F02D 35/023; F02D 41/062; F02N 11/08

USPC ..... 123/295, 305, 690, 479, 179.16, 179.3, 123/406.22; 73/119 A; 701/114, 116; 92/214

See application file for complete search history.

(56) References Cited

U.S. PATENT DOCUMENTS

| | | | | |
|---|---|---|---|---|
| 1,347,819 | A * | 7/1920 | Mooers | 92/214 |
| 5,881,694 | A * | 3/1999 | Nakada | 123/305 |
| 5,970,784 | A * | 10/1999 | Genin | 73/114.27 |
| 6,006,726 | A * | 12/1999 | Mai et al. | 123/406.26 |
| 6,138,638 | A * | 10/2000 | Morikawa | 123/295 |
| 6,170,322 | B1 | 1/2001 | Yamazaki et al. | |
| 6,378,358 | B1 | 4/2002 | Hirakata et al. | |
| 6,484,691 | B1 * | 11/2002 | Schuster et al. | 123/305 |
| 6,935,313 | B2 * | 8/2005 | Jacobson | 123/434 |
| 7,325,529 | B2 * | 2/2008 | Ancimer et al. | 123/299 |
| 2004/0112318 | A1 | 6/2004 | Wolfgang | |
| 2005/0103311 | A1 * | 5/2005 | Adachi et al. | 123/456 |
| 2005/0155565 | A1 * | 7/2005 | Mencher et al. | 123/90.15 |
| 2006/0116813 | A1 | 6/2006 | Tsuyuguchi et al. | |

FOREIGN PATENT DOCUMENTS

| | | |
|---|---|---|
| GB | 2255831 | 11/1992 |

* cited by examiner

*Primary Examiner* — Lindsay Low
*Assistant Examiner* — Jacob Amick
(74) *Attorney, Agent, or Firm* — Julia Voutyras; Alleman Hall McCoy Russell & Tuttle LLP

(57) ABSTRACT

A method for starting an internal combustion engine, the method comprising identifying cylinder stroke during the engine start responsive to a fuel rail pressure.

13 Claims, 4 Drawing Sheets

ENGINE POSITION IDENTIFICATION

BACKGROUND AND SUMMARY

Various approaches may be used to identify cylinder stroke in the engine firing order independent from camshaft information. In one example, manifold pressure may be used to identify cylinder stroke.

The inventors herein have recognized that such approaches may be inaccurate, especially during conditions in which the engine speed is low (such as during very low ambient temperature conditions and/or during weak battery conditions). Such inaccuracies may be especially difficult in direct injection engines, since fuel may be delivered at least partially during an expansion and/or compression stroke, in which case unburned fuel may be delivered to the exhaust without combustion.

As such, in one example, a method for starting an internal combustion engine may be used, the method comprising identifying cylinder stroke during the engine start responsive to a fuel rail pressure. In one particular example, the fuel rail pressure may be used during open fuel injector operation with the fuel pressure above ambient pressure, but below cylinder compression pressure near TDC. In this way, by monitoring whether the fuel rail pressure increases or decreases when the fuel injector is opened near TDC of the cylinder in which the injector is located, the stroke may be identified. For example if fuel rail pressure increases, then the stroke corresponds to TDC compression, but if it decreases, then the stroke corresponds to TDC exhaust. Note that this is just one example approach, and various others may be used.

DESCRIPTION

Figure 1:
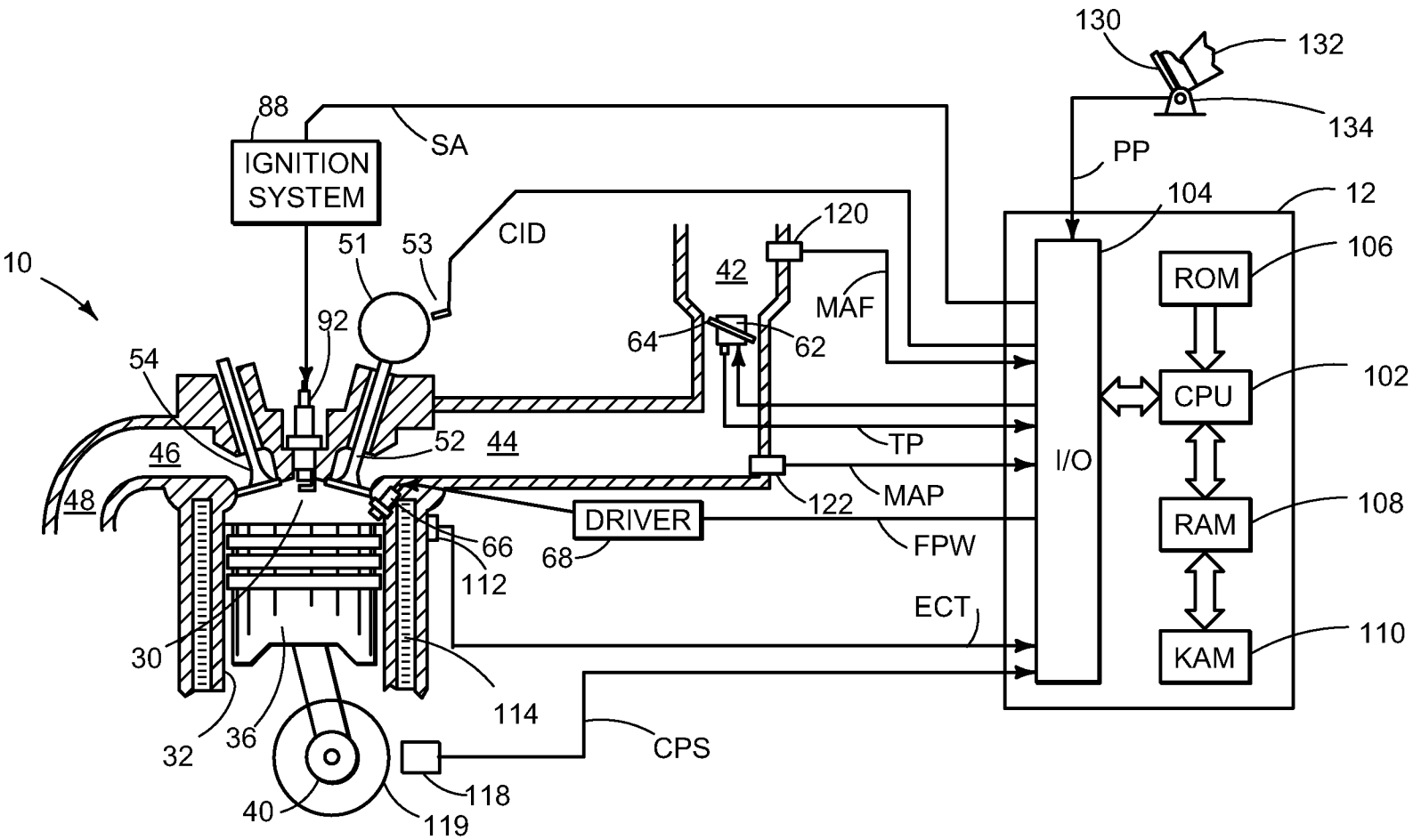
FIG. 1 shows an example engine cylinder system

FIG. 1 shows a detailed view of an example cylinder of a multi cylinder engine 10 As one example, engine 10 may be included in a propulsion system for a passenger vehicle. Engines 10 may be controlled at least partially by a control system including controller 12. Controller 12 can receive an input from a vehicle operator 132 via an input device 130. In this example, input device 130 includes an accelerator pedal and a pedal position sensor 134 for generating a proportional pedal position signal PP. Combustion chamber (i.e. cylinder) 30 of engine 10 may include combustion chamber walls 32 with piston 36 moveably disposed therein. Piston 36 is coupled to crankshaft 40 so that reciprocating motion of the piston is translated into rotational motion of the crankshaft. Crankshaft 40 may be coupled to at least one drive wheel of the vehicle via an intermediate transmission system. Alternatively, crankshaft 40 may be coupled to a generator for producing electrical energy, for example, where the engine is used in hybrid electric vehicle (HEV) or with generator applications. Further, a starter motor may be coupled to crankshaft 40 via a flywheel to enable starting of the engine.

Combustion chamber 30 may receive intake air from intake passage 42 via intake manifold 44 and may exhaust combustion gases via exhaust manifold 46 during operation where the cylinder provides net flow to the exhaust manifold. However, where the cylinder provides net flow to the intake manifold, exhaust gases produced by combustion chamber 30 or entrained from the exhaust manifold and/or air heated by the combustion chamber walls 32 may be exhausted to intake manifold 44 as will be describe in greater detail with reference to FIG. 4. Intake manifold 44 and exhaust manifold 46 can selectively communicate with combustion chamber 30 via respective intake manifold valve 52 and exhaust manifold valve 54, respectively. In some embodiments, combustion chamber 30 may include two or more intake manifold valves and/or two or more exhaust manifold valves.

Intake manifold valve 52 may be actuated by an intake camshaft having a toothed wheel 51. Likewise, exhaust manifold valve 54 may be actuated by an exhaust camshaft. In an alternative embodiment, a single overhead camshaft may actuated both the intake and exhaust valves, and also may be include the toothed wheel. In still another example, the toothed wheel may be coupled to the exhaust valve. A camshaft identification signal (CID) may be produced by a particular tooth or tooth pattern on wheel 51 as measured by sensor 53, which may be a hall effect sensor, variable reluctance sensor, or other sensor type. Likewise, a crankshaft position sensor 118 provide crankshaft position information (CPS) based on a toothed wheel 119, which may have a plurality of teeth or teeth patterns, including a missing tooth position. As with sensor 53, sensor 118 may be a hall effect sensor, variable reluctance sensor, or other sensor type.

As described in further detail below, based on the timing of receiving signals from sensors 53 and 118, the control system may identify engine position and/or the particular stroke of one or more cylinders (such as all of the cylinders) of the engine.

Fuel injector 66 is shown coupled directly to combustion chamber 30 for injecting fuel directly therein in proportion to the pulse width of signal FPW received from controller 12 via electronic driver 68. Fuel may be provided via fuel system (not shown), an example embodiment of which is described with regard to FIG. 2. In this manner, fuel injector 66 provides what may be referred to as direct injection of fuel into combustion chamber 30. The fuel injector may be mounted in the side of the combustion chamber or in the top of the combustion chamber, for example. Fuel may be delivered to fuel injector 66 by the fuel system including a fuel tank, a first and second fuel pump, and a fuel rail. In some embodiments, combustion chamber 30 may alternatively or additionally include a fuel injector arranged in intake manifold 44 in a configuration that provides what may be referred to as port injection of fuel into the intake port upstream of combustion chamber 30, where it may be entrained by the cylinder.

Intake passage 42 may include a throttle 64. In this particular example, the position of throttle 64 may be varied by controller 12 via a signal provided to an electric motor or actuator 62, a configuration that may be referred to as electronic throttle control (ETC). In this manner, throttle 64 may be operated to vary the intake air provided to intake manifold 44. The position of throttle 64 may be provided to controller 12 by a throttle position signal TP. Intake manifold 44 and/or intake passage 42 may include an mass air flow sensor 120 and an air pressure sensor 122 for providing respective signals MAF and MAP to controller 12.

Ignition system 88 can provide an ignition spark to combustion chamber 30 via spark plug 92 in response to spark advance signal SA from controller 12, under select operating modes.

Controller 12, as shown in FIG. 1, may be configured as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to the engine, in addition to those signals previously discussed, including measurement of inducted mass air flow (MAF) from mass air flow sensor 120; engine coolant temperature (ECT) from temperature sensor 112 coupled to cooling sleeve 114; throttle position (TP) from a throttle position sensor; and absolute manifold pressure signal, MAP, from sensor 122. Engine speed signal, RPM, may be generated by controller 12 from signal CPS. Manifold pressure signal MAP from a manifold pressure sensor may be used to provide an indication of vacuum, or pressure, in the intake manifold. In one example, sensor 118, which is also used as an engine speed sensor, may produce a predetermined number of equally spaced pulses every revolution of the crankshaft. Further, the fuel system may provide various signals and/or information to the controller, such as fuel rail pressure, as shown in FIG. 2.

Note that FIG. 1 shows only one cylinder of a multi-cylinder engine, and that each cylinder may similarly include its own set of intake/exhaust manifold valves, fuel injector, spark plug, etc. In one example, the engine cylinders may operate in a particular predetermined firing order, as determined by the valve timing.

Figure 2:
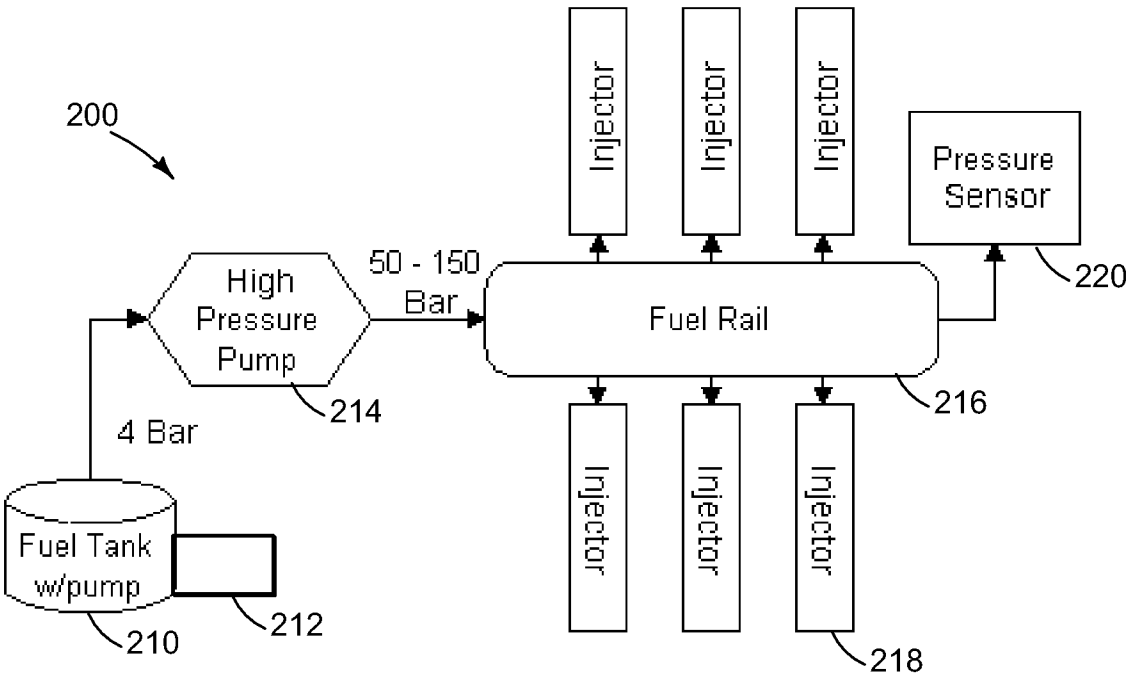
FIG. 2 shows an example fuel system

Referring now to FIG. 2, an example high pressure direct fuel injection system is schematically shown. In particular, fuel tank 210 is shown with a first fuel pump 212, which may be mounted internal, adjacent, or external to the fuel tank. The first fuel pump 212 may be referred to as a low pressure pump, that increases fuel pressure to approximately 4 bar. Pressurized fuel exits the first pump 212 and is delivered to a second fuel pump 214 which may be referred to as a high pressure pump, that increase fuel pressure to approximately 50-150 bar, depending on operating conditions. In one example, the second fuel pump 214 may have an adjustable pump stroke that may be adjusted by controller 12 to vary the increase in fuel pressure generated depending on operating conditions.

Continuing with FIG. 2, the second fuel pump 214 delivers further pressurized fuel to the fuel rail 216, which then distributes the fuel to a plurality of direct fuel injectors 218, one of which may be injector 66 shown in FIG. 1. A fuel rail pressure sensor 220 is also shown coupled to the fuel rail.

Note that while FIG. 2 shows various direct connections, such as between the first and second pumps, various additional valves, filters, and/or other devices may be intermediately connected, yet still enable the first and second pumps to be coupled.

As will be appreciated by one of ordinary skill in the art, the specific routines described below in the flow diagrams may represent one or more of any number of processing strategies such as event-driven, interrupt-driven, multi-tasking, multi-threading, and the like. As such, various acts or functions illustrated may be performed in the sequence illustrated, in parallel, or in some cases omitted. Likewise, the order of processing is not necessarily required to achieve the features and advantages of the example embodiments of the invention described herein, but is provided for ease of illustration and description. Although not explicitly illustrated, one of ordinary skill in the art will recognize that one or more of the illustrated acts or functions may be repeatedly performed depending on the particular strategy being used. Further, these figures may graphically represent code to be programmed into the computer readable storage medium in a controller.

Figure 3:
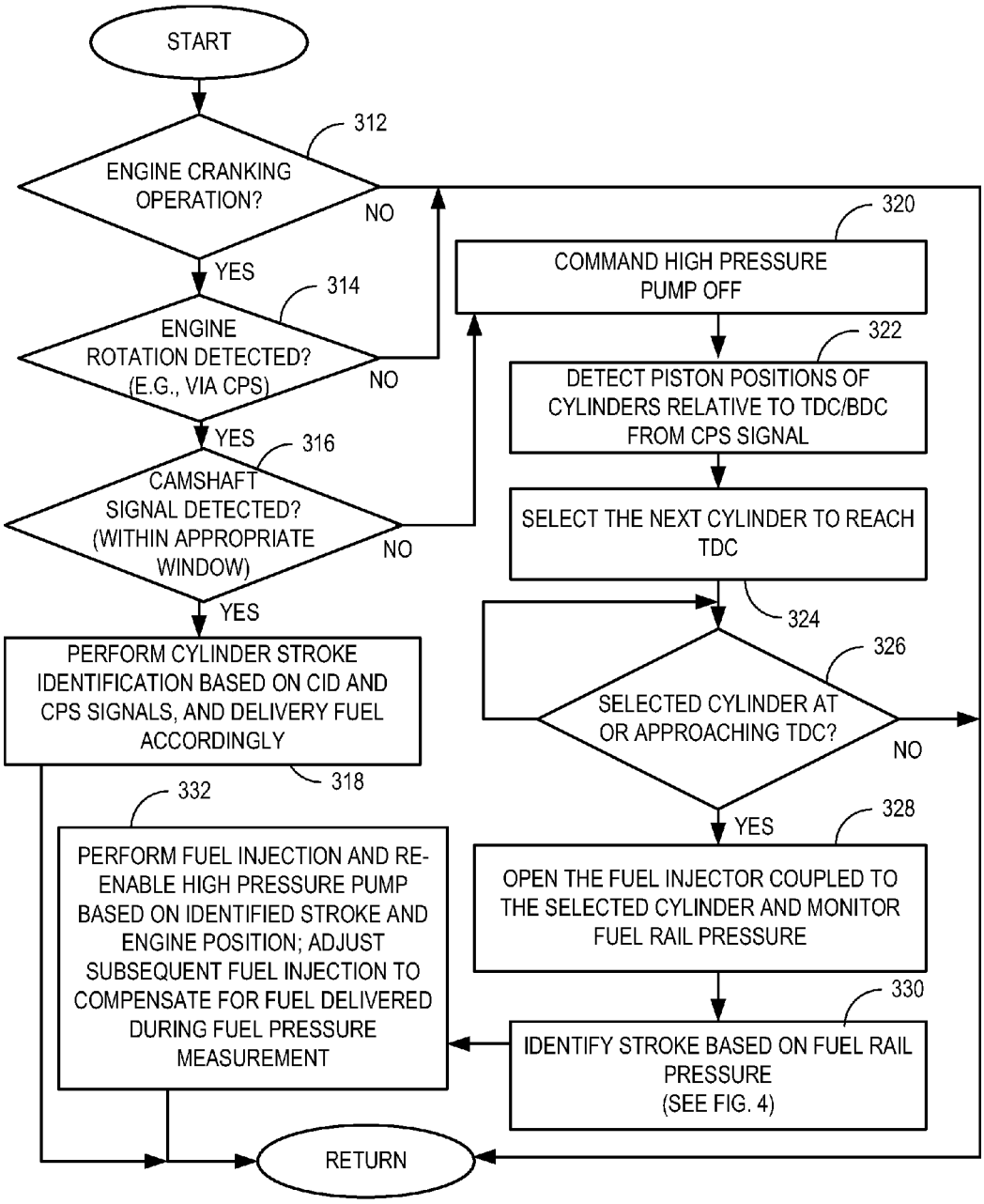
FIGS. 3-4 show example high level flowcharts of example control system operation.

Referring now to FIG. 3, a routine is described for engine starting operation. While not illustrated in FIG. 3, various additional operations may also be performed such as reading various sensors, enabling the first and second fuel pumps, etc.

First, in 312, the routine determines whether the engine is cranking. For example, the routine may monitor whether a starter motor is engaged, or whether another related motor, such as in a hybrid powertrain, is rotating the engine to start engine combustion operation. If so, the routine continues to 314 to determine whether engine rotation has been detected, such as via the CPS signal (which may be based on a missing tooth of wheel 119). If so, the routine continues to 316 to determine whether the CID signal has been detected within an expected window. For example, during cold conditions, such as when engine coolant temperature and/or air charge temperature are below a threshold value and/or if battery voltage is below a threshold, the CID signal may not be appropriately generated.

If the CID signal is identified, the routine continues to 318 to perform cylinder stroke identification based on the CID and CPS signals, and then delivers fuel accordingly. For example, once cylinder stroke is identified, the routine may perform sequential fuel injection to perform sequential combustion in the cylinders in the firing order of the engine, to thereby reduce fuel delivered to cylinders not on the appropriate (e.g., intake) stroke.

Alternatively, if the answer to 316 is no, the routine continues to 320 to carry out an alternative cylinder stroke identification sequence in which the fuel rail pressure may be used to identify cylinder stroke. Note that while in this example, the CID signal may not be provided due to cold temperatures, various other conditions may exist where a camshaft and/or crankshaft signal is degraded, such as due to sensor degradation over time, etc. The following cylinder identification based on fuel rail pressure may thus be used under these additional conditions, if desired.

Continuing with FIG. 3, in 320, the routine turns off the high pressure pump (if it was turned on) and leave the low pressure pump engaged (or turns it on if it was turned off). This operation effectively limits the fuel rail pressure to the pressure of the in-tank system (e.g., 4 bar). Then, in 322, the routine detects piston position of one or more cylinders relative to TDC and/or BDC based on the CPS and/or other operating parameters. From the position in 322, the routine selects and/or identifies the next cylinder expected to reach TDC in 324. For example, the routine may identify based on engine firing order and position of the crankshaft a next cylinder to be at or near piston TDC. Although a cylinder may then be selected at 324, it is not known at this point whether the cylinder stroke is at TDC of compression or TDC of exhaust.

In 326, the routine monitors the selected cylinder to determine when it is at or near TDC, such as based on the CPS signal. When this condition is present, the routine continues to 328 to open the fuel injector associated with the selected cylinder (e.g., the injector may be turned on) and the fuel rail pressure is monitored. Then, in 330, the routine identifies the cylinder stroke based on the fuel rail pressure response, as described in further detail with regard to FIG. 4. After identifying the cylinder stroke, the routine then proceeds to 332 to perform synchronous fuel injection, re-enable high pressure fuel pump. For example, after the fuel injector closes, the high pressure pump may be enabled and may be adjusted responsive to the fuel rail pressure sensor to achieve a desired fuel rail pressure for fuel injection after synchronization. Further, the routine may adjust subsequent fuel injections to account for fuel delivered during the fuel pressure monitoring (328/

330). In one example, because only the low pressure pump was enabled, the amount of fuel compensation should be relative small.

Figure 4:
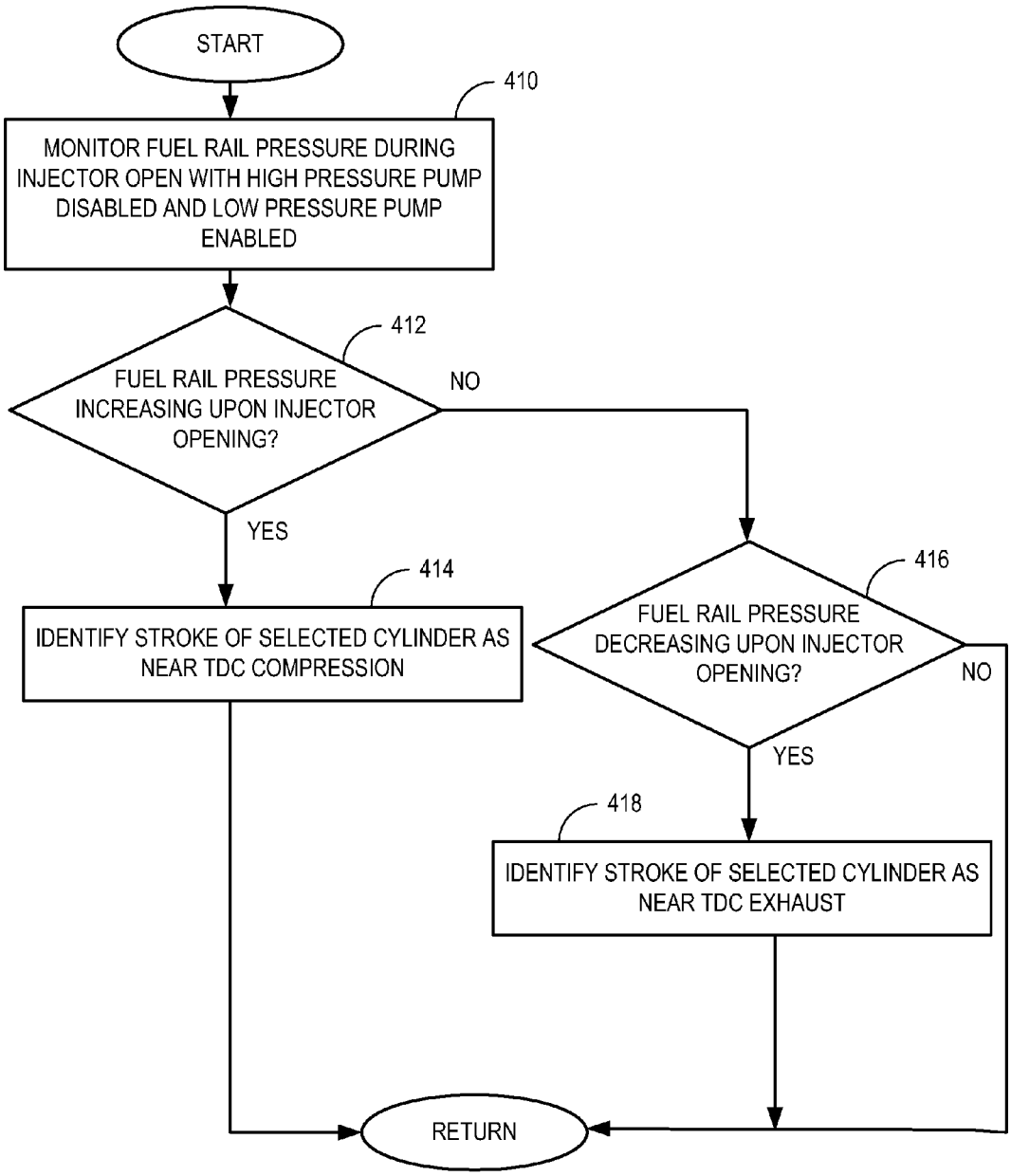

Referring now to FIG. 4, additional details for determining cylinder stroke based on fuel rail pressure are provided. Specifically, in 410, the routine monitors the fuel rail pressure during the injector open operation with the high pressure pump disabled and the low pressure pump enabled, as noted above with regard to FIG. 3. Then, in 412, the routine determines whether the fuel rail pressure increased upon the injector opening. If so, the routine identifies the cylinder stroke of the selected cylinder to be at or near TDC compression. Specifically, if the cylinder is near TDC compression, the in-cylinder pressure will be around 10 bar, for example, depending on the valve timing, engine compression ratio, etc. When the injector is turned on during this cycle, the fuel rail pressure may increase due to the negative pressure different across the injector (rail pressure–in-cylinder pressure). However, as noted in 416 and 418, when the fuel rail pressure decreases, the stroke is near TDC exhaust. Specifically, if the cylinder is near TDC exhaust, the in-cylinder pressure will be near atmospheric (1 bar, for example). When the injector is turned on during this cycle, the fuel rail pressure may drop due to the positive pressure difference across the injector (rail pressure–in-cylinder pressure). Thus, the positive or negative change in fuel rail pressure may provide sufficient information to synchronize the engine position, with minimal, if any emissions impact.

While the above example illustrates operation when the CID signal is insufficient, for example, it may also be possible to use the fuel rail pressure to determine if the CID signal is being improperly generated due to sensor degradation. For example, even when the CID is being received during cranking, the above approach may be used to determine the accuracy of the CID signal. Further still, while the above approach illustrates operation where fuel rail pressure is monitored for a single cylinder fuel injector opening duration, it may be expanded to monitor fuel rail pressure over a plurality of fuel injector openings for a plurality of cylinders as their respective pistons pass near TDC. Such operation may provide improved identification as additional information may be provided. The plurality of selected cylinders may be selected to be sequential cylinders, cylinders in phase, cylinders out of phase (e.g., 180 crank angle degrees out of phase), etc. Additionally, the routine may select two cylinders known to be out of phase in the firing order to improve the accuracy in stroke identification to provide increased separation between fuel rail pressure measurement intervals. I.e., the respective two fuel injectors may be opened 180 degrees out of phase so that the two measurement opportunities minimally affect one another.

It will be appreciated that the configurations and routines disclosed herein are exemplary in nature, and that these specific embodiments are not to be considered in a limiting sense, because numerous variations are possible. The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for starting an engine, comprising:

identifying a cylinder's stroke during an engine start, the cylinder stroke identification responsive to a fuel rail pressure monitored during opening of a direct fuel injector coupled to the cylinder, the opening near top dead center of piston position for the cylinder, and disabling a high pressure fuel pump of a fuel system during the monitoring of fuel rail pressure to identify cylinder stroke and enabling a low pressure fuel pump of the fuel system during the monitoring of fuel rail pressure to identify cylinder stroke.

2. The method of claim 1 where the fuel rail pressure is monitored based on a fuel rail pressure sensor coupled to a fuel rail of the engine, and where the direct fuel injector is coupled to the fuel rail.

3. The method of claim 2 further comprising compensating subsequent fuel injection to the cylinder based on an amount of fuel delivered during the identification of cylinder stroke.

4. The method of claim 3 further comprising identifying cylinder stroke during another engine start responsive to a crank sensor and a cam sensor.

5. The method of claim 3 further comprising re-enabling the high pressure fuel pump after identifying cylinder stroke.

6. The method of claim 3 further comprising performing sequential fuel injection after identifying cylinder stroke.

7. The method of claim 3 wherein the cylinder stroke identification is independent of data from a camshaft sensor, including during degradation of the camshaft sensor.

8. The method of claim 3 further comprising determining degradation of a cylinder identification sensor based on the cylinder stroke identification.

9. The method of claim 3 wherein the identification of cylinder stroke includes determining in which of an intake, compression, power, and exhaust stroke the cylinder is currently operating.

10. A system for starting an internal combustion engine, the system comprising:

a fuel rail;

at least one cylinder having a direct fuel injector coupled therein, the direct fuel injector coupled to the fuel rail;

a first fuel pump and a second fuel pump, the second fuel pump configured to increase fuel pressure above pressure generated by the first fuel pump, the second pump coupled between the first pump and the fuel rail;

a fuel rail pressure sensor coupled to the fuel rail; and a control system with instructions stored in non-transitory memory to crank the engine and operate with the first fuel pump enabled and the second fuel pump disabled, where the control system includes instructions to identify cylinder stroke while the direct fuel injector is open in response to an output of the fuel rail pressure sensor, and subsequently deliver fuel injection to the engine cylinders synchronously in response to the identified cylinder stroke, where the synchronous fuel delivery is responsive to a direction of change of the output of the fuel rail pressure sensor generated by opening the direct fuel injector during the cranking.

11. The system of claim 10 further comprising a crank angle sensor, where the fuel delivery is further responsive to the crank angle sensor.

12. A system for starting an internal combustion engine, the system comprising:

a fuel rail;

at least one cylinder having a piston and direct fuel injector coupled therein, the direct fuel injector coupled to the fuel rail;

a first fuel pump and a second fuel pump, the second fuel pump configured to increase fuel pressure above pressure generated by the first fuel pump, the second fuel pump coupled between the first fuel pump and the fuel rail;

a fuel rail pressure sensor coupled to the fuel rail; and a control system with instructions stored in non-transitory memory to crank the engine and operate with the first fuel pump enabled and the second fuel pump disabled, where the control system includes instructions to identify cylinder stroke based on an output of the fuel rail pressure sensor while the direct fuel injector is open near top dead center of the piston position and while fuel pressure is above ambient pressure, but below cylinder compression pressure, and subsequently deliver fuel to engine cylinders synchronously in response to the identified cylinder stroke, where the synchronous fuel delivery and cylinder stroke identification are responsive to a direction of change of an output of the fuel rail pressure sensor generated by opening the direct fuel injector during the cranking, the control system further enabling the second fuel pump after the opening of the direct fuel injector.

13. The system of claim 12 where the control system further adjusts operation of at least one of the first and second fuel pumps responsive to the fuel rail pressure sensor after the direct fuel injector is closed.

* * * * *